United States Patent [19]

Erdman et al.

[11] Patent Number: 4,457,044

[45] Date of Patent: Jul. 3, 1984

[54] MULTIPLE FLIGHT ELEVATOR SYSTEM

[75] Inventors: Garard C. Erdman, Pomona; John L. Cottam, Rancho Cucamonga; Leonard S. Cox, Beaumont; Richard B. Rosseau, Clairmont, all of Calif.

[73] Assignee: FMC Corporation, Chicago, Ill.

[21] Appl. No.: 431,948

[22] Filed: Sep. 30, 1982

[51] Int. Cl.[3] ..... E01H 1/04

[52] U.S. Cl. ..... 15/348; 15/83

[58] Field of Search ..... 15/340, 348, 83, 86, 15/82

[56] References Cited

U.S. PATENT DOCUMENTS

| | | | |
|---|---|---|---|
| 1,328,521 | 1/1920 | Jemmison | 15/83 |
| 1,585,768 | 5/1926 | Clayton et al. | 15/83 |
| 2,911,737 | 11/1959 | Von Arx | 15/83 X |
| 3,363,274 | 1/1968 | Tamny | 15/84 |
| 3,584,325 | 6/1971 | Larsen et al. | 15/83 |
| 3,584,326 | 6/1971 | Woodworth | 15/84 |
| 3,649,982 | 3/1972 | Mortensen | 15/84 |
| 3,668,730 | 6/1972 | Scharmann et al. | 15/83 |
| 3,670,359 | 6/1972 | Gutbrod | 15/348 |
| 3,726,109 | 4/1973 | Mortensen | 64/30 |
| 3,805,310 | 4/1974 | Oberdank | 15/83 |
| 3,893,286 | 7/1975 | Buttram et al. | 15/82 X |
| 3,978,545 | 9/1976 | Morel | 15/83 |
| 4,200,953 | 5/1980 | Overton | 15/349 |

FOREIGN PATENT DOCUMENTS

| | | | |
|---|---|---|---|
| 1573501 | 8/1980 | United Kingdom | 15/83 |

*Primary Examiner*—Chris K. Moore

*Attorney, Agent, or Firm*—A. J. Moore; H. M. Stanley; R. B. Megley

[57] ABSTRACT

A multiple flight elevator system is disclosed for use in a mobile sweeper in combination with a pick-up broom and a debris receiving hopper. The elevator features the combination of mechanical elevating means which moves heavy articles or bulky masses of debris upwardly within the hopper while relying on a low volume blower for moving light articles and dust into the hopper providing a cleaner swept surface and minimizing the exhaust dust problem. Two embodiments are disclosed each including a plurality of independently driven flexible resilient paddle wheels in combination with a low volume blower for progressively raising the debris from the broom through an elevator housing and into the hopper. The lower end of the housing of the first embodiment is disposed close to the surface being cleaned and the housing is pivoted to the sweeper chassis in order to move over contacted abutments. The lower end of the housing of the second embodiment is spaced well above the road surface and the housing is rigidly secured to the chassis. A flexible resilient debris guide extends downwardly from the housing and is movable connected to the housing and to the broom support arms to pivot and deflect relative to the housing.

11 Claims, 12 Drawing Figures

FIG_2
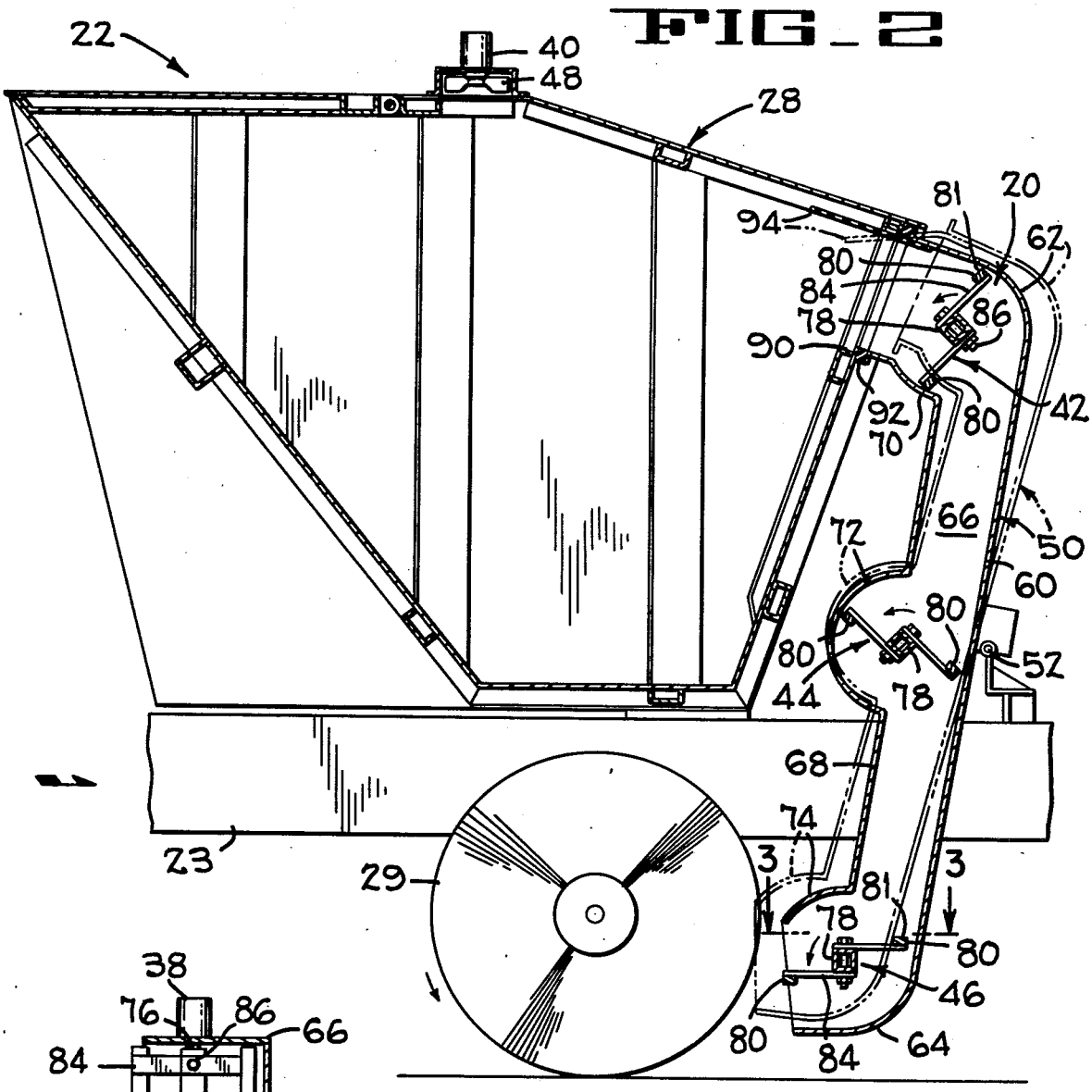
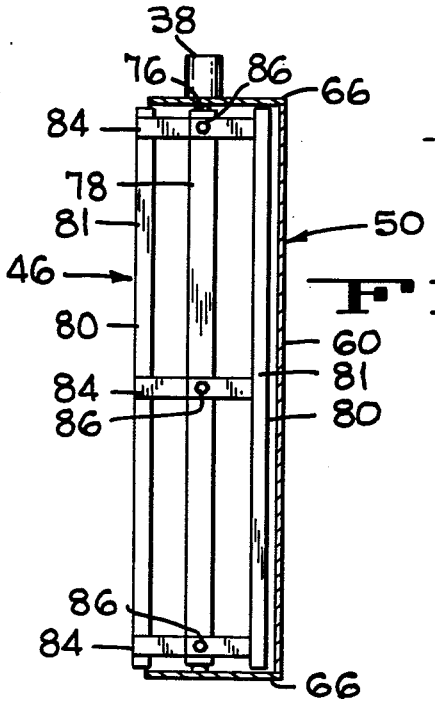
FIG_3
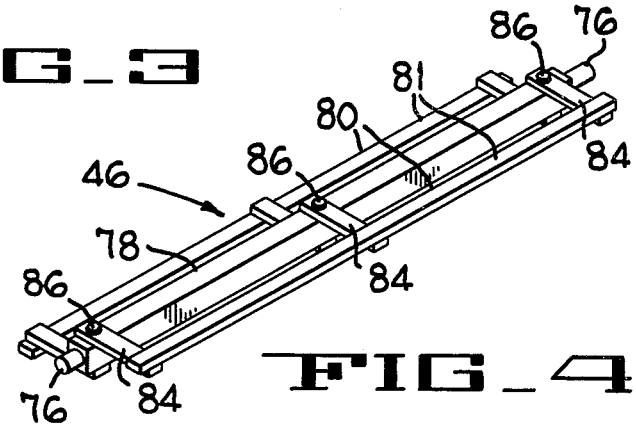
FIG_4

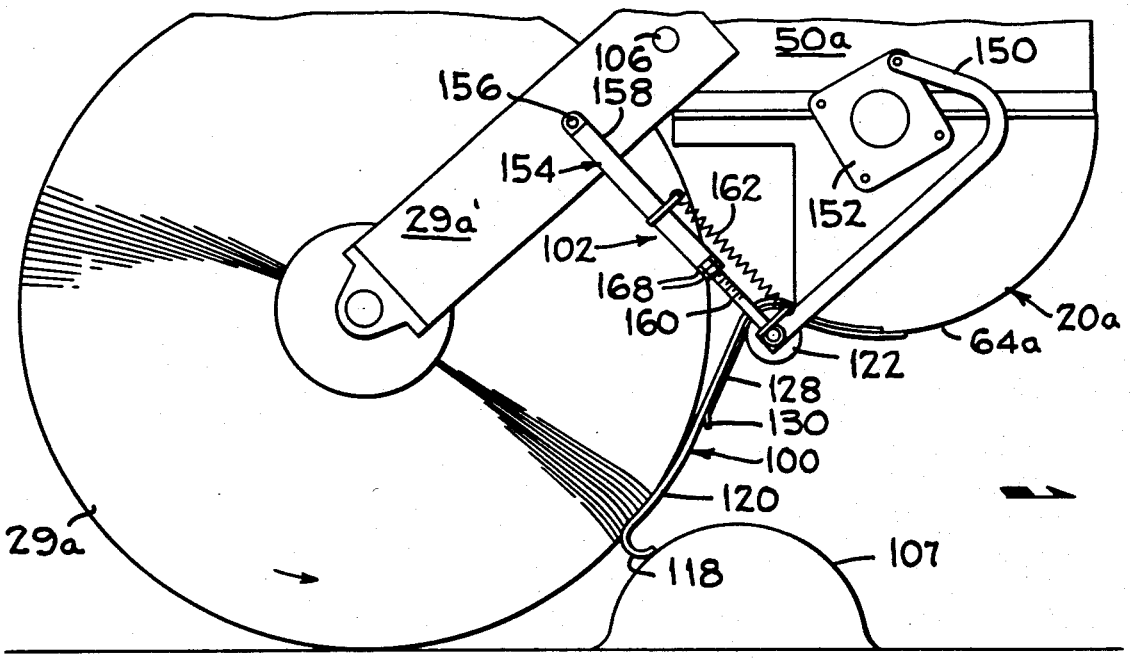
FIG_9
FIG_10
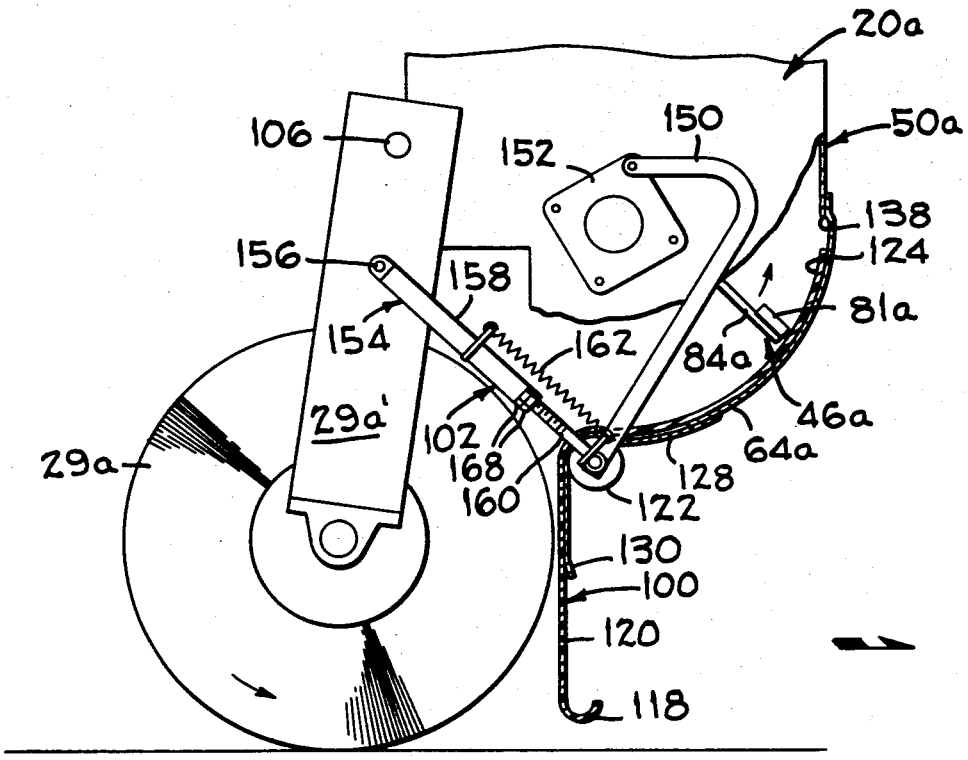

MULTIPLE FLIGHT ELEVATOR SYSTEM

CROSS REFERENCE TO RELATED APPLICATIONS

The present invention is related to the inventions disclosed in the following applications, all filed on even date herewith, and all presently assigned to the assignee of the present invention:

Kassai Application Ser. No. 431,947 entitled Sweeper With Hydraulically Driven Components.

Rosseau Application Ser. No. 431,959 entitled Debris Collection System For Street Sweepers.

Gunnarsson Application Ser. No. 431,494 entitled Hopper Support And Dump Mechanism.

The disclosures of the above identified applications are incorporated by reference herein.

BACKGROUND OF THE INVENTION

1. Field of the Invention

The present invention relates to street sweepers or the like and more particularly relates to an improved multiple flight debris elevating system for the sweeper.

2. Description of the Prior Art

Elevating systems which use an enldess conveyor with flights thereon for elevating debris collected by a rotary broom are well known in the art as evidenced by United States Pat. No. 3,363,274 which issued to Tamny on Jan. 16, 1968; and U.S. Pat. No. 3,584,326 which issued to Woodworth on June 15, 1971. This type of elevator also requires expensive elevator take-up mechanisms which require considerable expenditures of time to maintain the elevators properly tensioned.

Several United States patents disclose single rotary type dirt elevators for use on sweepers when the required lift is very low. The following patents are representative of this type of elevator:

Mortensen U.S. Pat. No. 3,649,982 dated Mar. 21, 1972; Scharmann et al 3,668,730 dated June 13, 1972; Mortensen U.S. Pat. No. 3,726,109 dated Apr. 10, 1973; Oberdank U.S. Pat. No. 3,805,310 dated Apr. 23, 1974; and Overton U.S. Pat. No. 4,200,953 dated May 6, 1980.

Prior art sweepers which use only vacuum to elevate debris to the hopper are well known in the art. These sweepers are required to pick up heavy articles, such as metal bars about 1" in diameter and 3" long. Since air is used to pick up these heavy articles, the debris from the pick up broom swath is diverted from the pick-up broom swath to a narrow swath adjacent a gutter broom so that a relatively small debris inlet opening will collect all swept debris and elevate it to the hopper. By providing a small inlet opening, the air velocity is fast enough to pick up heavy articles. Since only air is used to pick up both heavy and light debris, one disadvantage is that the elevating power requirement is excessively high. A separate engine of about 120 horsepower is required for driving the blower which provides about 13,000 cubic feet per minute of air at a pressure of about 5" of water. Another disadvantage of air elevators is that the air velocity is very high (about 100 ft/second) thereby presenting a substantial dust control problem. Dust and solids enter the hopper but because of the very high air velocity, the dust does not have time to separate from the air with the result that a substantial cloud of dust is discharged from the hopper into the atmosphere. Another problem is that the air inlet does not span the swath of the pick-up broom and accordingly much fine debris in the pick-up broom swath is not picked up but remains on the surface being cleaned.

SUMMARY OF THE INVENTION

An important feature of the present invention is the concept of using the combination of mechanical elevating means for lifting or propelling at least the heavy articles into the hopper, and using a small blower for creating a low velocity, easily controlled updraft of air through the elevator housing for elevating light debris thereby reducing elevator power requirements, minimizing the amount of dust discharged from the hopper, and yet removing light particles and dust from the swath of the pick-up broom resulting in a cleaner surface being swept. With the combined mechanical and air lift elevator, the blower requires about 10 horsepower to draw about 650 cubic feet of air per minute through the elevator housing at a pressure of about ½ inch of water and a velocity of about 3.5 feet per second.

In accordance with a first embodiment of the present invention a debris elevator for a mobile sweeper is disclosed which cooperates with a driven pick-up broom that directs debris into the elevator for conveyance into the upper portion of a debris hopper. The elevator includes a pivotally supported elevator housing having means such as a plurality of rotatable paddle wheels therein which lift at least the heavy debris into the hopper. A small blower is provided to create a low velocity updraft of air of about 650 cubic feet per minute at a pressure of about ½ inch of water to air in pulling light articles such as leaves, paper, and dust through the elevator housing into the hopper.

In accordance with a second embodiment of the present invention a debris elevator for a mobile sweeper is disclosed which cooperates with a driven pick-up broom that directs debris into the elevator for conveyance into the upper portion of a debris hopper. The elevator includes an elevator housing fixed to the chassis of the vehicle and having a plurality of rotatable paddle wheels therein including a lower paddle wheel which propels some heavy debris directly into the hopper or which cooperates with at least one other paddle wheel to progressively lift the debris into the hopper with the aid of a low velocity updraft of air. A movable resilient debris guide plate projects downwardly from the elevator housing and is resiliently coupled to the pick-up broom to resiliently move toward or away from the broom in response to engagement with large volumes of debris, a large debris articles, or obstructions in the road. The resilient coupling also permits the guide plate to move with the broom between a transport position raised a significant distance above the surface being cleaned and an operative position against the surface being cleaned.

BRIEF DESCRIPTION OF THE DRAWINGS

FIG. 2 is an enlarged vertical central section taken through the hopper, the pick-up broom and a first embodiment of the debris elevator system of the present invention, certain parts being omitted for clarity.

FIG. 3 is a section taken along lines 3—3 of FIG. 2 illustrating one of the paddle wheels and a portion of the elevator housing of the elevator system.

FIG. 4 is a perspective of the paddle wheel of FIG. 3.

FIG. 9 is an operational view taken at a smaller scale than FIG. 8 illustrating a full size pick-up broom with the debris guide plate engaging a speed bump in the road and being urged against the broom.

FIG. 10 is an operational view taken at the same scale as FIG. 9 but illustrating the operative position of the debris guide plate relative to a pick-up broom which has been reduced in diameter due to wear.

DESCRIPTION OF THE PREFERRED EMBODIMENT

Figure 1:
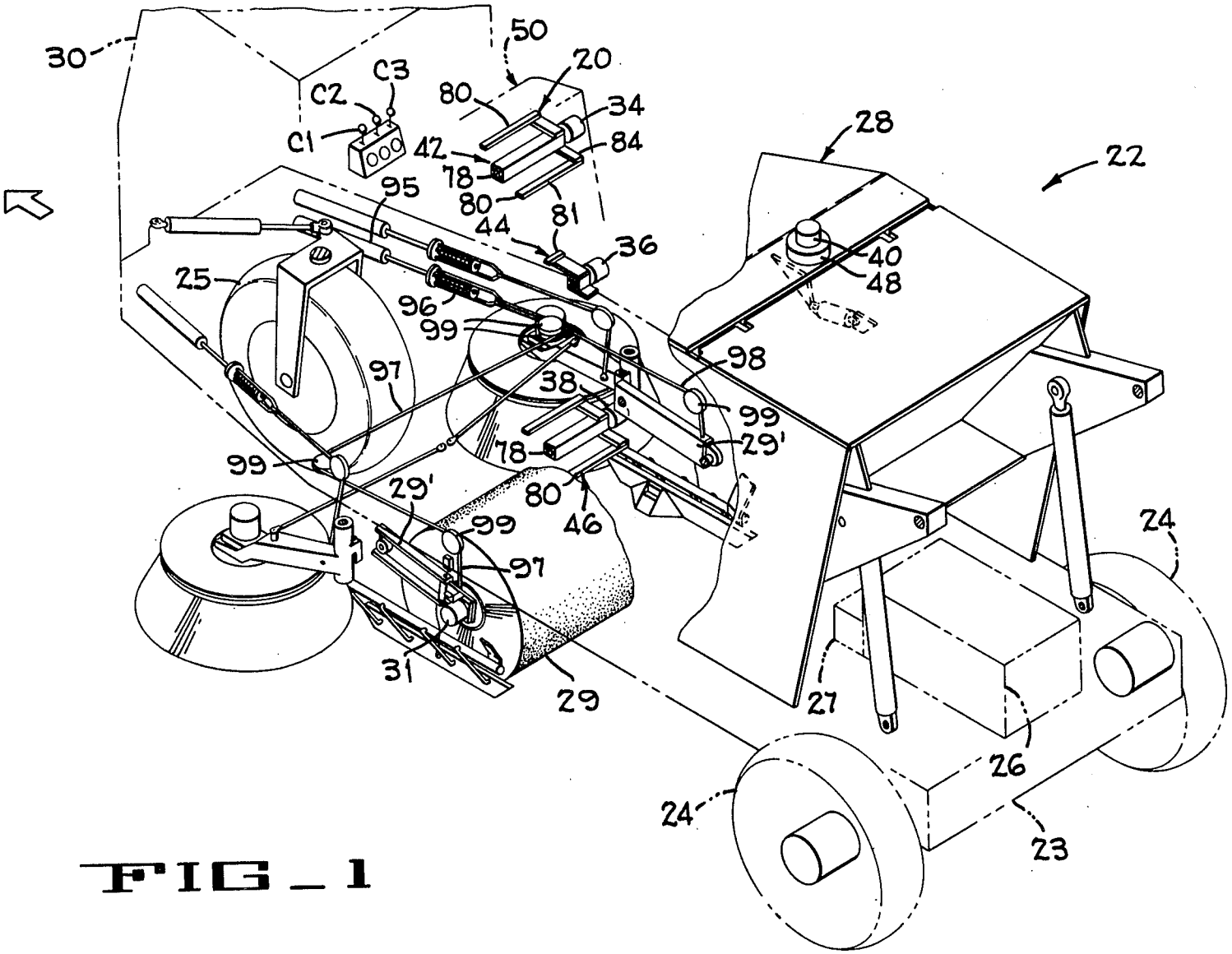
FIG. 1 is a diagrammatic perspective with parts broken away illustrating a mobile street sweeper which incorporates the elevator system of the present invention and also illustrates the drive mechanism for the several components of the sweeper.

The first embodiment of the multiple flight elevator system 20 (FIGS. 1 and 2) is illustrated as a component of a street sweeper 22 (FIG. 1). The street sweeper 22 includes a chassis 23 supported by a driven pair of rear wheels 24 and a single steerable wheel 25. The several components of the sweeper 22 receive power from an engine 26 which drives a hydraulic pump 27 that directs hydraulic fluid to several hydraulic motors. The sweeper components include a debris hopper 28, a pick-up broom 29 supported by pivot arms 29′ and the elevator 20. An operator selectively manipulates controls such as controls C1, C2 and C3 in a cab 30 to control the several hydraulic motors; including a motor 31 which drives the pick-up broom 29, and hydraulic motors 34,36,38 and 40 which drive three paddle wheels 42,44,46 and a small blower 48 (FIG. 2), respectively. If a more detailed description of the hydraulic circuit is desired, reference may be had to the aforementioned Kassai application.

As illustrated in FIGS. 2–4, the first embodiment of the multiple flight elevator system 20 includes an elevator housing 50 which is pivoted to the chassis 23 by a pivot pin 52 and suitable brackets. The pivot arms 29′ of the first embodiment are pivoted to the elevator housing. The housing 50 may be pivoted between the solid line operating position and a raised position such as indicated in dotted lines in FIG. 2 to prevent breakage of the housing in the event an abutment in the road is hit or additional road clearance is required.

The housing 50 includes a planar front wall 60 having arcuate upper and lower portions 62,64 which extend rearwardly relative to the direction of movement of the street sweeper 22. A pair of side walls 66 are connected to the front wall and to a rear wall 68 having three arcuate portions 70,72 and 74 therein. The three paddle wheels 42,44 and 46 are journaled in the side wall 66 for rotation within the arcuate portions 70,72 and 74, respectively. The housings of the hydraulic motors 34,36 and 38 (FIG. 1) are bolted to the adjacent side walls 66, and the rotors of the motors are each keyed to an adjacent stub shaft 76 (FIGS. 3 and 4) of the associated paddle wheel.

Each paddle wheel 42,44,46 includes the stub shafts 76 which are secured to a tubular shaft 78 of square cross section. A pair of flexible resilient paddles 80 are formed from urethane or the like and include long and narrow debris propelling portions 81, reinforced by a steel channel molded therein, connected to the tubular shaft by a plurality of resilient arms 84 and bolts 86 (FIG. 3 and 4). The substantial open space between the debris propelling portions 81 and the shaft 78 prevents excessive pumping of air, and accordingly considerably reduces the power required by the paddle wheels.

In the event a large article such as a rock or board becomes wedged between the housing and one of the propelling portions 81, the associated arms 84 resiliently deflect and permit the portion 81 to move past the obstruction allowing the next portion 81 to engage and propel the large article (or large volume of debris) upwardly toward the hopper 28. the lower end of the elevator 20 (FIG. 2) is disposed adjacent the pick-up broom 29 and the surface being swept. The upper end of the elevator 20 communicates with a hopper inlet opening 90, adjacent the upper end of the debris hopper 28, and is gravitationally urged against an annular resilient hopper seal 92 to minimize loss of debris. A resilient flap 94 is secured to the upper edge of the elevator housing 50 to minimize loss of debris when the housing is pivoted out of engagement of the seal 92 to the dotted line position during operation in response to the lower end contacting an abutment, or when the hopper is dumped. Since the pick-up broom pivot arms 29′ are pivoted to the elevator frame, retraction of an operator control hydraulic cylinder 95 (FIG. 1) will elevate the pick-up broom 29 to the transport position and will pivotally raise the lower end of the elevator housing to the dotted line position of FIG. 2 with the aid of a resilient connector 96, a pair of cables 97,98 and cooperating direction control sheaves 99.

In operation of the first embodiment of the multiple flight elevator system 20 of the present invention, an operator starts the engine 26 and drives the sweeper to the road or other surface to be cleaned. The operator then operates controls C1–C3 to lower the pick-up broom 29 into operative sweeping position, and directs hydraulic fluid into the hydraulic motor 31 of the pick-up broom 29, the hydraulic motors 34,36 and 38 of the paddle wheels 42,44 and 46, and the hydraulic motor 40 of the blower 48. The pick-up broom 29 and paddle wheels 42,44 and 46 are thus driven in the direction indicated by the arrows in FIG. 2, and the blower 48 creates an updraft through the elevator housing at a low rate of about 3.5 feet per second to aid in lifting leaves or the like through the housing 50 and direct them to the rear of the hopper 28.

As the sweeper 22 is driven over the surface being cleaned, the pick-up broom 29 forms a pile of debris in front of the broom, and then slings the debris into the lower end of the elevator housing 50 which is about 5.25 inches above the surface being cleaned. The propelling portions 81 of the lower paddle wheel 46 then engages and propels the debris directly into the hopper or to the next paddle wheel 44 which propels it to the upper paddle wheel 42 which slings it toward the rear of the hopper 28. The debris movement through the housing 50 is aided by the blower 48 which causes movement of air therethrough.

If the vehicle is driven over a curb or speed bump which engages the lower end of the housing 50, the housing will pivot clockwise (FIG. 2) to a position such as the dotted line position and will gravitationally return to the solid line position (aided by a spring or the like if necessary) after moving over the abutment.

The pick-up broom 29 (FIG. 1) is driven by the hydraulic motor 31 at a rate of about 180 revolutions per minute, and the paddle wheels are preferably driven at about 210 RPM or slightly faster in order to remove debris from the elevator faster than it is received from the pick-up broom. It is apparent that the diameter of the pick-up broom 29 will vary considerably due to wear and thus its peripheral speed will decrease with wear.

A second embodiment of the elevator system 20*a* of the present invention is disclosed in FIGS. 5–12 and is in many respects similar to that of the first embodiment. Accordingly, parts of the second embodiment that are similar to those of the first embodiment will be assigned the same numerals followed by the letter "a" and only the differences will be described in detail.

The primary differences between the two embodiments is that the lowermost point of the elevator housing 50*a* is raised a considerable distance above the surface being swept thus eliminating the ground clearance problem present in the first embodiment and permitting the elevator housing 50*a* to be rigidly secured to the chassis 23*a*, rather than being pivotally secured thereto as in the first embodiment; two paddle wheels 42*a*,46*a* of larger diameter relative to the pick-up broom 29*a* than used in the first embodiment are preferably used, as opposed to the three paddle wheels used in the first embodiment; and a flexible and bodily movable debris guide plate 100 is movably attached to the lower portion of the housing 50*a* and is resilient connected to the pick-up broom pivot arms 29'*a* by an adjustable linkage mechanism 102 on each side of the vehicle which maintains the guide plate 100 at the optimum spacing from the periphery of the pick-up broom unless large pieces, or excessive volumes, of debris is being propelled by the pick-up broom into the housing 50*a*.

The guide plate 100 will be raised and lowered with the pick-up broom in response to the pick-up broom being pivoted about axis 106 either due to ground surface variations or operator controlled raising of the pick-up broom to its elevated transport position (not shown). Upon engagement with a street abutment, such as speed bump 107 (FIG. 9), the guide plate 100 will deflect against the pick-up broom 29*a* which causes the pick-up broom and guide plate to raise over the bump with the aid of the single hydraulic cylinder 95 (FIG. 1) operatively connected to the arms 29'*a*, which are pivotally supported by the chassis. Since the elevator housing is rigidly secured to the chassis 23*a*, and since the hopper 28*a* (which includes a blower similar to the blower 48 shown in FIGS. 1 and 2) is pivoted rearwardly when dumped, the lower portion of the forward wall 109 (FIG. 5) of the hopper 28*a* is designed to provide adequate clearance for accommodating pivotal movement of the hopper.

More particularly, the debris guide plate 100 is formed from a rather stiff but flexible and resilient plastic material 112 (FIGS. 6 and 7) having an expanded metal rear wall 114 embedded therein. The plastic material and expanded metal is vertically severed at 116 in the lower portion thereof to improve the flexibility in this area.

Figure 8:
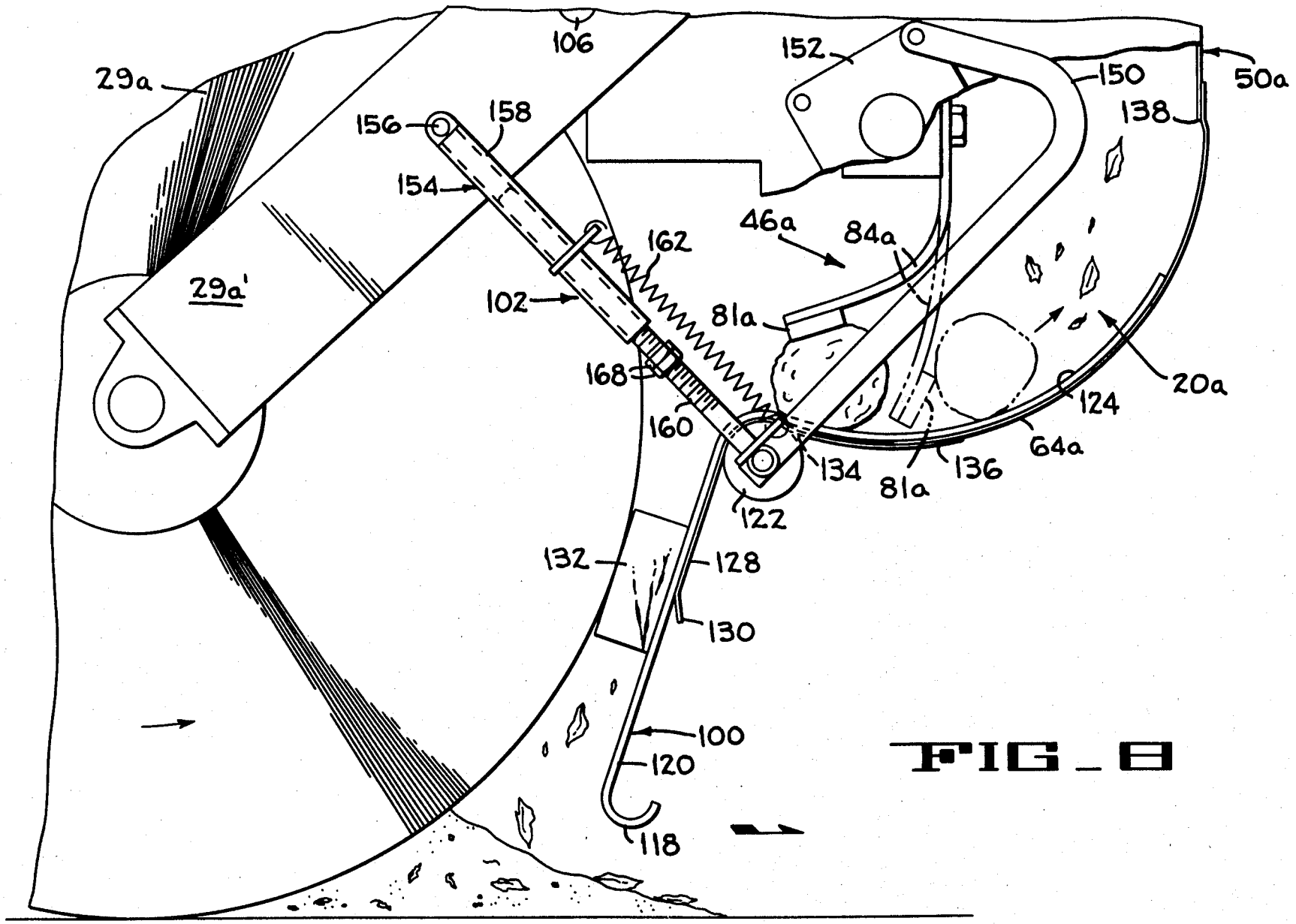
FIG. 8 is an enlarged operational view of the lower portion of the elevator system illustrating the debris guide plate being urged away from a full size pick-up broom by a large article such as a 2×4 inch board.
Figure 11:
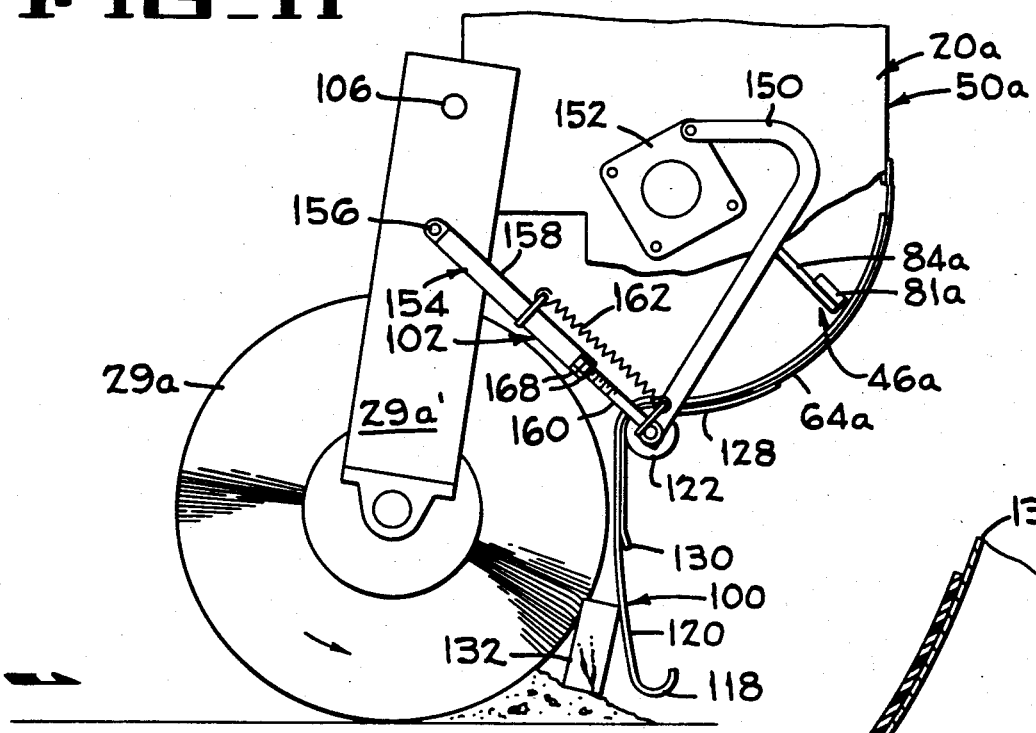
FIG. 11 is an operational view similar to FIG. 10 but illustrating a large object such as a 2×4 inch board being urged between the broom and the debris guide plate prior to the guide plate being urged away from the broom.
Figure 12:
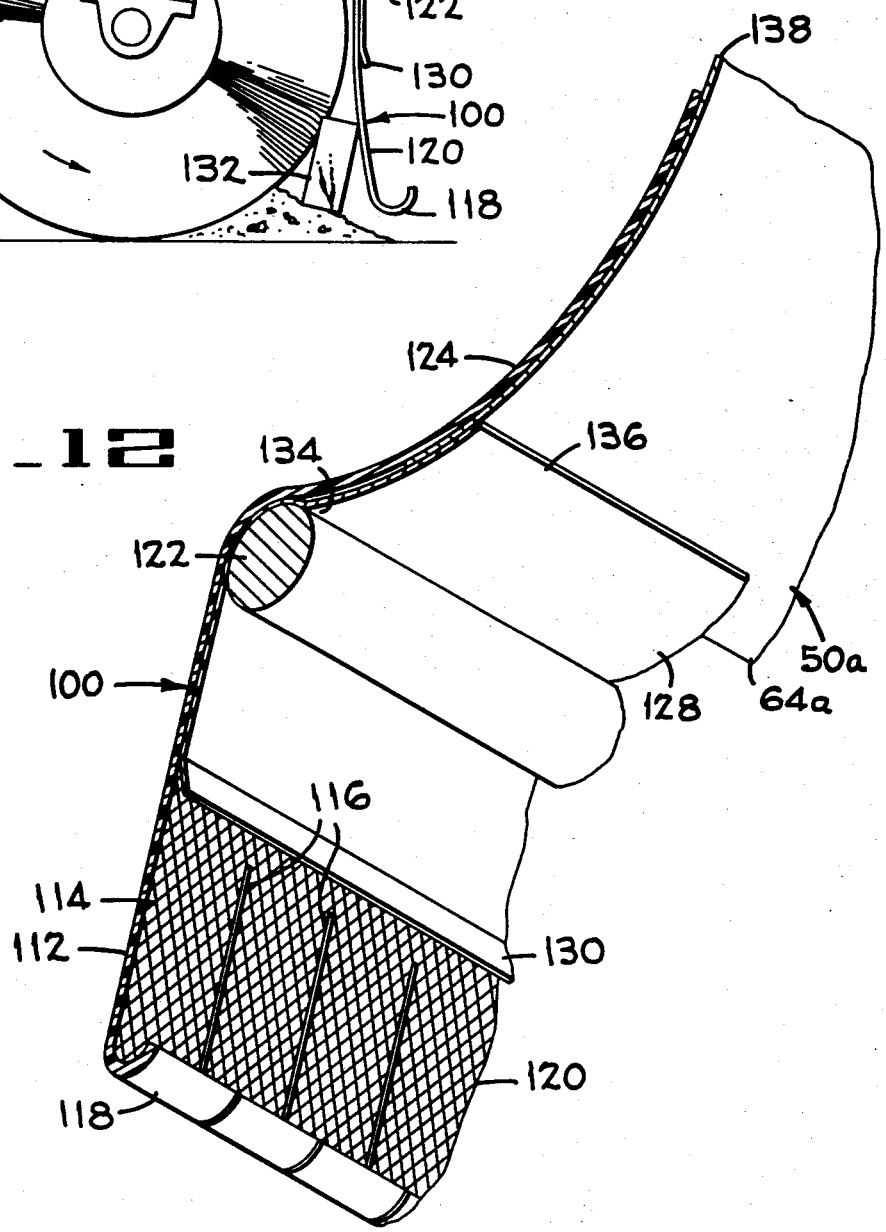
FIG. 12 is an enlarged perspective taken in vertical section illustrating the sliding connection between the debris guide plate and the elevator housing.

The guide plate 100 has a lower transversely extending arcuate edge 118 formed as an arc to prevent the plate 100 from digging into the pick-up broom 29*a* when in the position shown in FIG. 9. The arcuate edge 118 (FIGS. 5 and 8) is formed on the lower edge of a normally planar debris guiding portion 120 having its upper portion conforming to the curvature of a transverse support bar 122 to which the guide plate 100 is secured as by bolting (not shown). The guide plate terminates in an arcuate portion 124 (FIGS. 8 and 12) slidably received in and conforming to the shape of the lower arcuate portion 64*a* of the elevator housing 50*a* for slidable movement therein. A guide plate stiffener 128 is disposed between the support bar 122 and the guide plate 100. The lower edge 130 of the stiffener 128 is angled away from the portion 120 to stiffen the upper area about which the portion 120 will start to bend when engaging a large article such as a board 132 as illustrated in FIG. 11. As shown in FIGS. 8 and 12, the upper portion of the guide plate stiffener 128 is bent downwardly at 134 to provide an arcuate guide portion 136 which slidably engages the external surface of the lower arcuate wall of the elevator housing 50*a*. Thus, said arcuate housing wall is slidably received between the arcuate portion 124 of the guide plate and the arcuate portion 136 of the stiffener 128. The limits of bodily movement of the guide plate 100 is determined by the lower transverse edge of the elevator housing 50*a* being contacted by the bend line 134; or the upper edge of the guide portion 136 contacting a transverse abutment 138 (FIG. 8) of the elevator housing 50*a*.

Figures 5, 6, 7:
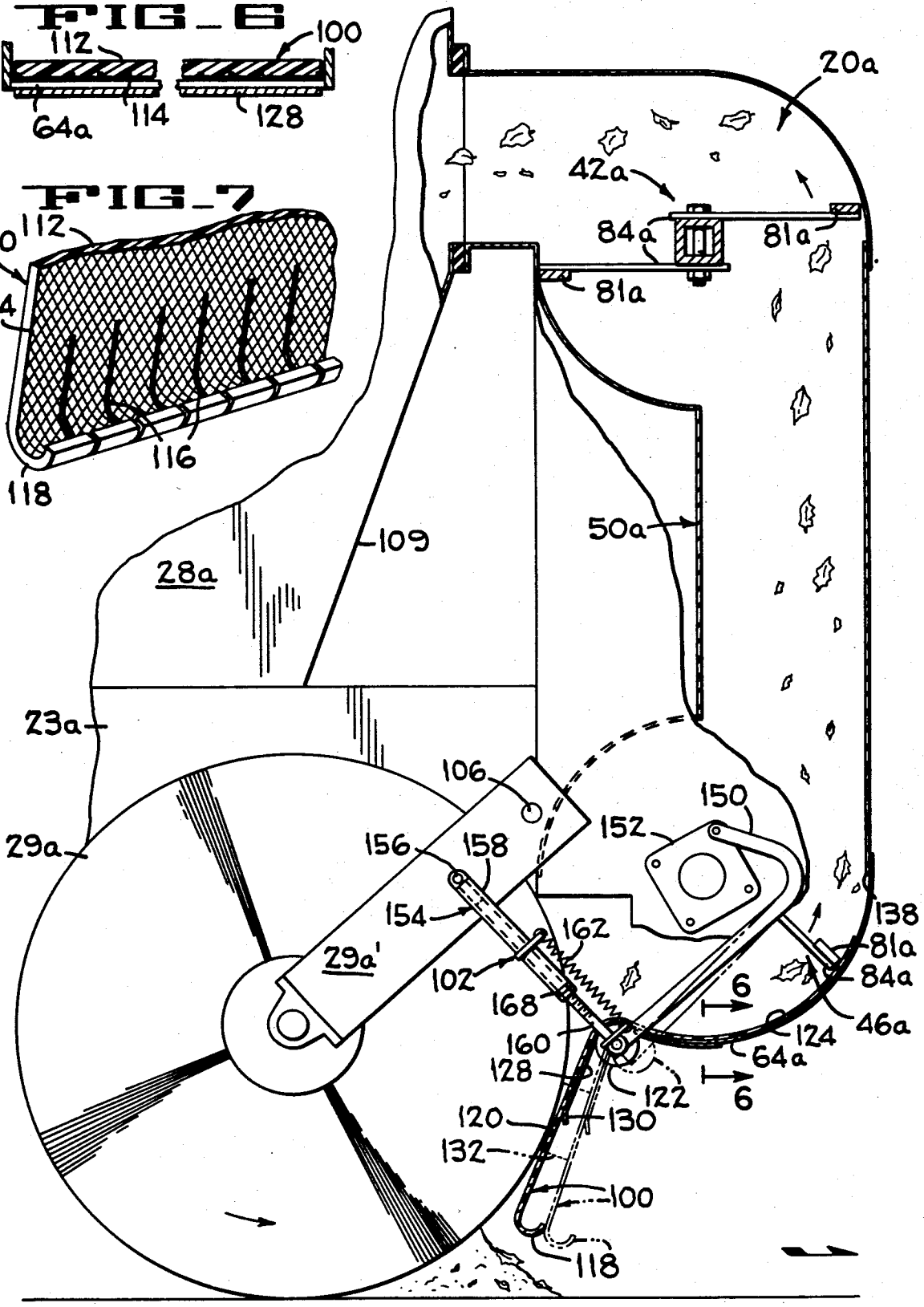
FIG. 5 is an enlarged side elevation illustrating a second embodiment of the debris elevator system of the present invention associated with the hopper and an unworn pick-up broom, certain parts being cut away to illustrate other parts in section.
FIG. 6 is an enlarged section taken along lines 6—6 of FIG. 5 illustrating a fragment of the elevator housing and debris guide plate with the central portion cut away.
FIG. 7 is a perspective of the lower resilient portion of the debris guide plate.

Each linkage mechanism 102 (FIGS. 8–11) comprises an angle shaped first link 150 which is pivoted to the bearing housing 152 that supports the lower paddle wheel 46*a*; and to one end of the bar 122. An extensible link 154 is pivotally connected to the bar 122 and to the adjacent pick-up broom pivot arm 29'*a* at 156. The link 154 includes a tubular portion 158 and a threaded rod 160 slidably received therein. A spring 162 is connected between the tubular portion and the threaded rod 160 thereby resiliently urging the two link sections together. A pair of locknuts 168 are secured on the rod 160 in position to maintain the desired normal debris spacing between the periphery of the pick-up broom 29*a* and the guide plate 100. This spacing will be maintained during normal operation when the broom is unworn as indicated in FIGS. 5 and 8, or is worn as indicated in FIGS. 10 and 11.

When a large article, such as the article 132 (FIGS. 8 and 11), is first moved into engagement between the pick-up broom and the debris guide plate 100, the plate will first deflect as indicated in FIG. 11 thereafter the article 132 will cause the extensible link 154 to extend against the urging of the spring 162 thus permitting the article to move into the housing as illustrated in FIG. 8. If the article 132 or another large article such as the rock illustrated in FIG. 8 becomes wedged between the housing and one of the propelling portions 81*a* of the paddle wheel 46a, the resilient arms 84a will deflect as indicated in FIG. 8 allowing the next propelling portion 81a to engage and advance the article to the hopper or to the next higher paddle wheel 42a (FIG. 5).

In the event the sweeper 22 is driven over the speed bump 107, or the like, as illustrated in FIG. 9, the debris guide plate 100 will deflect against the periphery of the pick-up broom as indicated. The force of the plate 100 against the broom will cause the broom and plate 100 to pivot upwardly. After the plate rides over the bump 107, the pick-up broom 29a will move downwardly against the bump 107 with a predetermined surface engaging or sweeping force thus sweeping debris away from the bump 107. When the pick-up broom is lifted above the ground into its transport position, it will be apparent that the linkage 102 will also lift the guide plate 100 upwardly.

It will be understood that the concept of using a mechanical elevator to lift the heavy debris into the hopper; and using a low velocity updraft of air to elevate the light particles such as leaves, paper and dust into the hopper; may use other types of conventional mechanical elevators in the combination in place of the preferred multiple paddle wheel elevators.

From the foregoing description it is apparent that the first embodiment of the invention includes three hydraulically driven paddle wheels within a pivotally supported housing for receiving and progressively conveying debris from the pick-up broom to the hopper with the aid of a low volume blower, and with the lower paddle wheel propelling heavy articles directly into the hopper or cooperating with the other paddle wheels to progressively lift the debris to the upper end of the hopper. The pivotal housing will pivot away from obstructions on the surface being cleaned, and the use of independently driven paddle wheels eliminates the need for costly and time consuming elevator take-up devices which require frequent adjustment.

The second embodiment of the invention features a fixed elevator housing for accommodating at least two paddle wheels, which housing is elevated a sufficient distance above the surface being cleaned to pass over obstructions thereon. A resilient debris guide plate is movably connected to the housing and to the pick-up broom pivot arms by telescopic means for guiding debris into the elevator housing. When large debris is elevated by the pick-up broom, the guide plate will pivot forwardly from its normal position to allow passage of the debris. When an abutment on the surface being cleaned is contacted by the lower end of the guide plate, the plate applies a lifting force to the pick-up broom thus allowing the guide plate to move over the abutment and the pick-up broom to immediately drop and sweep over the abutment.

Although the best mode contemplated for carrying out the present invention has been herein shown and described, it will be apparent that modification and variation may be made without departing from what is regarded to be the subject matter of the invention.

What is claimed is:

1. In a power driven mobile sweeper having a chassis which supports a hopper with an inlet opening near the upper end thereof, and a power driven pick-up broom supported by said chassis for movement between a raised position and an operative sweeping position engaging the surface to be cleaned, the improvement which comprises:

means defining an elevator housing supported by said chassis having a debris inlet opening adjacent said broom and a debris discharge opening communicating with said hopper inlet opening, said housing including arcuate end portions communicating with said inlet and discharge openings and having an upright planer debris guiding surface disposed therebetween;

means defining a driven mechanical elevator in said elevator housing for receiving debris from said pick-up broom and for elevating at least the heavy pieces and large volumes of debris into the hopper;

said elevator including a plurality of driven paddle wheels with the lower paddle wheel propelling some debris along a path adjacent said planar guiding surface directly into the hopper and will progressively elevate other debris to the next higher paddle wheel with the uppermost paddle wheel discharging the debris into the hopper, each said paddle wheel including transversely extending shaft means journaled in said elevator housing and connected to a pair of transversely extending long and narrow debris propelling portions that are connected to said shaft means by a plurality of resilient arms for providing large debris passages between said shaft means and said propelling portions; and a driven blower for creating a low velocity easily controlled updraft of air through the elevator housing for elevating light debris into the hopper resulting in a more effective removal of dust and light debris from the surface being swept and minimizing the power required by the blower.

2. An apparatus according to claim 1 wherein the blower requires about 10 horsepower to draw about 650 cubic feet of air per minute through the elevator housing at a pressure of about ½ inch of water and at a velocity of about 3.5 feet per second.

3. An apparatus according to claim 1 wherein said housing includes arcuate portions for rotatably receiving adjacent paddle wheels, and wherein said upright planar debris guiding surface of said housing causes the housing to be necked down between said arcuate portions for more effectively guiding debris to the next higher paddle wheel.

4. An apparatus according to claim 1 wherein said paddle wheels each include debris propelling paddles formed from resilient material and capable of deflecting over large masses of debris or large articles in order to avoid jamming of the elevator.

5. In a power driven mobile sweeper having a chassis which supports a hopper with an inlet opening near the upper end thereof, and a power driven pick-up broom supported by said chassis for movement between a raised position and an operative sweeping position engaging the surface to be cleaned, the improvement which comprises means defining an elevator housing supported by said chassis having a debris inlet opening adjacent said broom and a debris discharge opening communicating with said hopper inlet opening, means defining a plurality of vertically spaced paddle wheels within said elevator housing, offset pivot means for pivotally supporting said elevator housing on said chassis for urging the upper end thereof toward the front of the vehicle for allowing the lower end of said elevator to pivot rearwardly and upwardly in the event an abutment on the surface being cleaned is contacted, and power means connected to said paddle wheels for driving each said paddle wheel in a direction and at a speed which will elevate some debris directly into the hopper or will progressively elevate debris to the next higher paddle wheel with the uppermost paddle wheel discharging the debris into said hopper.

6. In a power driven mobile sweeper having a chassis which supports a hopper with an inlet opening near the upper end thereof, and a power driven pick-up broom supported by said chassis for movement between a raised position and an operative sweeping position engaging the surface to be cleaned, the improvement which comprises:

means defining an elevator housing supported by said chassis having a debris inlet opening adjacent said broom and a debris discharge opening communicating with said hopper inlet opening, means defining a plurality of vertically spaced paddle wheels within said elevator housing, power means connected to said paddle wheels for driving each said paddle wheel in a direction and at a speed which will elevate some debris directly into the hopper or will progressively elevate debris to the next higher paddle wheel with the uppermost paddle wheel discharging the debris into said hopper, a power driven low volume blower for creating a low volume updraft through said elevator housing for aiding the upward movement of leaves or the like through said housing and into the hopper, means defining a debris guide plate, means for supporting said guide plate adjacent said broom for guiding debris from said broom into said housing, and said guide plate being formed from a flexible resilient material and includes a transversely extending arcuate lower edge for preventing said lower edge from penetrating the periphery of said broom in the event said guide plate is bent rearwardly against the broom in response to engagement with an abutment on the surface being swept.

7. An apparatus according to claim 6 wherein said housing includes an arcuate lower wall, wherein said guide plate includes an arcuate extension in slidable engagement with one side of said arcuate housing wall, said guide plate supporting means additionally comprising: a pair of adjustable linkages connected between said associated broom supporting arms and said guide plate for maintaining said plate at a predetermined spacing from the periphery of the broom during normal operation of the sweeper.

8. An apparatus according to claims 6 or 7 wherein each of said adjustable linkages comprises a tubular portion pivotally connected to the associated arms, a second link portion slidably received within said tubular portion and operatively connected to said guide plate, adjustable lock means on said second link portion for providing said predetermined spacing, and resilient means connected between said tubular link portion and said second link portion for allowing large volumes or large pieces of debris to increase the spacing between said guide means and the periphery of said broom against the urging of said resilient means.

9. An apparatus according to claim 8 wherein said support means additionally comprises:

a transversely extending stiffener having an arcuate portion in slidable engagement with the other side of said arcuate housing, a bar rigidly secured to said guide plate and to said stiffener and extending transversely thereof, a pair of linkage arms, said arms pivotally connecting an associated side of said housing to the adjaent end of said bar, and means pivotally connecting said second link to the adjacent end of said bar for controlling arcuate movement of said guide plate.

10. An apparatus according to claim 7 wherein said one side of said arcuate housing wall is the inner surface.

11. An apparatus according to claim 6 wherein said paddle wheel drive means includes a hydraulic motor for each paddle wheel.

* * * * *